US008602094B2

(12) United States Patent
Sihler

(10) Patent No.: US 8,602,094 B2
(45) Date of Patent: Dec. 10, 2013

(54) METHOD FOR DOWNHOLE ELECTRICAL TRANSMISSION BY FORMING AN ELECTRICAL CONNECTION WITH COMPONENTS CAPABLE OF RELATIVE ROTATIONAL MOVEMENT

(75) Inventor: Joachim Sihler, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 71 days.

(21) Appl. No.: 13/226,627

(22) Filed: Sep. 7, 2011

(65) Prior Publication Data

US 2013/0056195 A1 Mar. 7, 2013

(51) Int. Cl.
*E21B 43/00* (2006.01)

(52) U.S. Cl.
USPC ..... 166/65.1; 166/68; 166/105; 417/372

(58) Field of Classification Search
USPC ..... 166/65.1, 68, 105; 175/315, 56, 320, 175/321, 92; 415/220; 439/21–27, 29; 417/312, 329, 423.3, 372
See application file for complete search history.

(56) References Cited

U.S. PATENT DOCUMENTS

| | | | | |
|---|---|---|---|---|
| 3,195,646 | A * | 7/1965 | Brown | 166/208 |
| 4,361,194 | A * | 11/1982 | Chow et al. | 175/107 |
| 5,265,682 | A | 11/1993 | Russell et al. | |
| 5,368,110 | A * | 11/1994 | French | 175/57 |
| 5,407,011 | A * | 4/1995 | Layton | 166/376 |
| 5,582,678 | A | 12/1996 | Komuro | |
| 5,603,385 | A | 2/1997 | Colebrook | |
| 5,676,212 | A * | 10/1997 | Kuckes | 175/45 |
| 5,964,307 | A * | 10/1999 | Wenzel | 175/321 |
| 6,050,349 | A * | 4/2000 | Rountree et al. | 175/40 |
| 7,188,685 | B2 | 3/2007 | Downton et al. | |
| 7,819,666 | B2 * | 10/2010 | Sihler et al. | 439/26 |
| 7,828,082 | B2 * | 11/2010 | Pabon et al. | 175/56 |
| 7,832,503 | B2 | 11/2010 | Sand et al. | |
| 8,162,044 | B2 * | 4/2012 | Sihler | 166/65.1 |
| 2010/0139980 | A1 | 6/2010 | Neves et al. | |

FOREIGN PATENT DOCUMENTS

| | | |
|---|---|---|
| SU | 1078046 | 3/1984 |
| SU | 1362817 | 12/1987 |

OTHER PUBLICATIONS

International Search Report for the equivalent PCT patent application No. PCT/US2012/053429 issued on Nov. 15, 2012.

* cited by examiner

*Primary Examiner* — Minh Trinh
(74) *Attorney, Agent, or Firm* — Chadwick A. Sullivan; Brigitte Jeffery Echols

(57) ABSTRACT

A method facilitates transmission of electric signals across well components which move relative to each other in a wellbore environment. The method utilizes well components which are movably, e.g. rotatably, coupled to each other via one or more conductive bearings. Each conductive bearing has a conductive rolling element which enables relative movement, e.g. rotation, between the well components while simultaneously facilitating transmission of electric signals through the bearing. The method also involves coupling portions of the bearing to each of the well components, and those bearing portions may be connected with electric leads to enable flow of electric signals through the bearing during operation of the system downhole.

11 Claims, 3 Drawing Sheets

METHOD FOR DOWNHOLE ELECTRICAL TRANSMISSION BY FORMING AN ELECTRICAL CONNECTION WITH COMPONENTS CAPABLE OF RELATIVE ROTATIONAL MOVEMENT

BACKGROUND

In a variety of downhole applications, electric signals are transmitted along the wellbore to or from various sensors and tools. For example, electric signals may be transmitted via conductors positioned in or along well strings, e.g. along drill strings. In drilling applications and other downhole applications, electric signals are sometimes transmitted across components which move relative to each other, e.g. electric signals may be transmitted from a rotationally stationary component to a rotating component. Transmission of electrical signals across moving components creates difficulties in many of these applications.

In some applications, transmission of electric signals across components which move relative to each other can be avoided by placing the sensor/tool above the moving component. In other applications, the signals may be transmitted across the moving components with an electromagnetic telemetry system, such as a short-hop system. However, existing electromagnetic telemetry systems tend to be relatively expensive and are often more complex than desired for downhole drilling applications and other downhole applications.

SUMMARY

In general, the present disclosure provides a method for enabling transmission of electric signals across well components which move relative to each other in a wellbore environment. The method utilizes well components which are movably, e.g. rotatably, coupled to each other via one or more conductive bearings. Each conductive bearing has a conductive rolling element which enables relative movement, e.g. rotation, between the well components while simultaneously facilitating transmission of electric signals through the bearing. The method also comprises coupling portions of the bearing to each of the well components, and those bearing portions may be coupled with electric leads to enable flow of electric signals through the bearing during operation of the system downhole.

BRIEF DESCRIPTION OF THE DRAWINGS

Certain embodiments of the disclosure will hereafter be described with reference to the accompanying drawings, wherein like reference numerals denote like elements, and.

DETAILED DESCRIPTION

Figure 1:
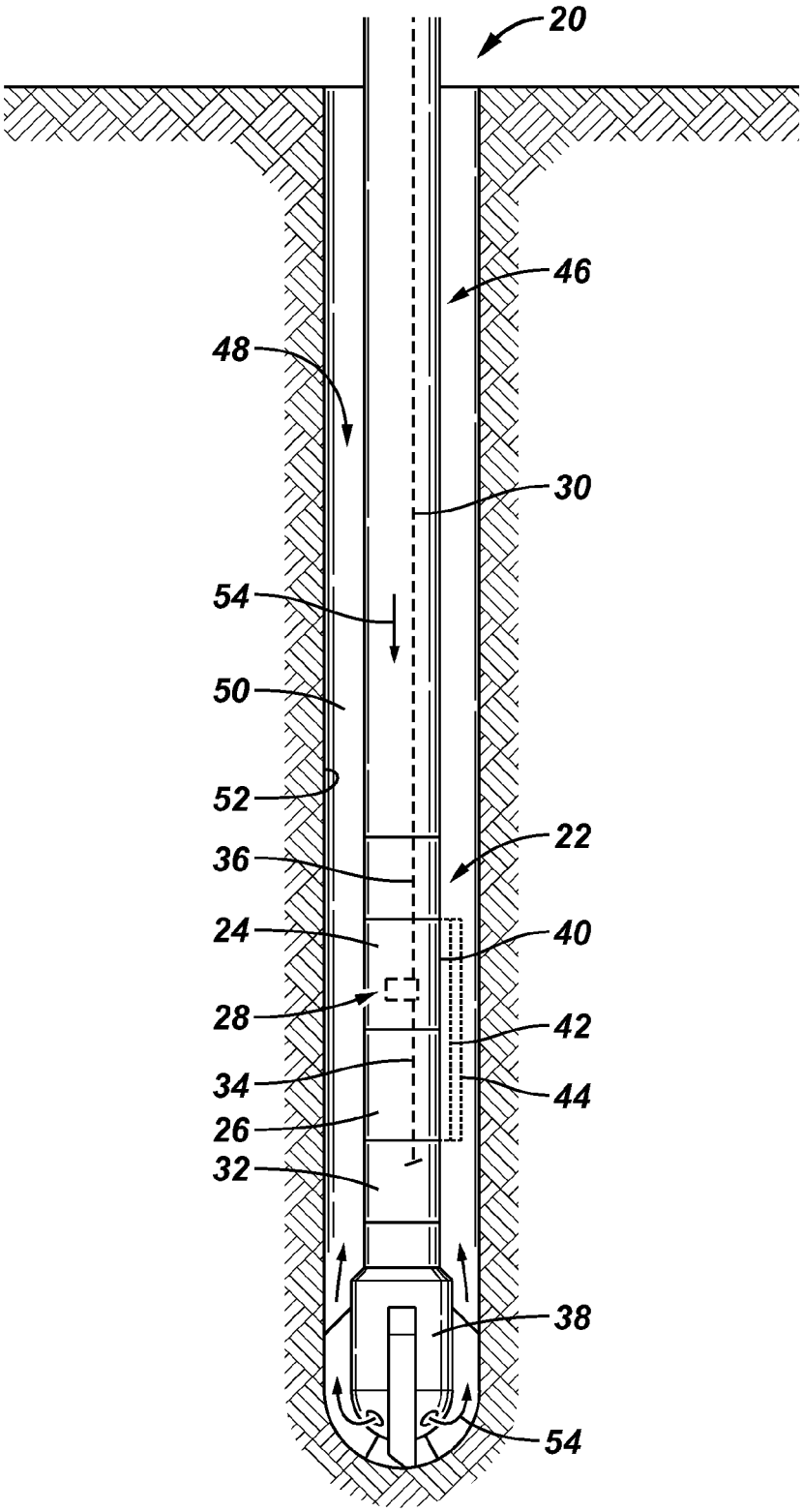
FIG. 1 is a schematic illustration of a well system, e.g. a drilling system, deployed in a wellbore and incorporating conductive bearings, according to an embodiment of the present disclosure.

In the following description, numerous details are set forth to provide an understanding of the present disclosure. However, it will be understood by those of ordinary skill in the art that the present disclosure may be practiced without these details and that numerous variations or modifications from the described embodiments may be possible.

The present disclosure generally relates to a system and methodology to form electrical connections across components in a downhole well assembly. In many applications, the technique facilitates formation of one or more conductive paths along a well system which has components that move relative to one another. The components are movably, e.g. rotatably, coupled to each other via an electrically conductive bearing which has a conductive rolling element. Additionally, electric leads may be coupled to opposing sides of the bearing to enable flow of electric current through the bearing, including through the conductive rolling elements of the bearing, to facilitate communication with and/or transfer of electrical power to/from devices positioned farther downhole from the components that undergo relative motion.

A variety of downhole tools have components which move relative to each other during well related operations, such as drilling operations. For example, mud motors and orienter tools have a downhole or bottom component which rotates at different speeds (and typically independent speeds) relative to the uphole or upper component. Other downhole tools, including rotary steerable systems and other bottom hole assemblies, also utilize components which have relative motion with respect to each other. One example of such a tool is the PowerDrive Control unit which is available from Schlumberger Corporation and has a roll-stabilized platform that is geostationary while a collar component rotates at a drill bit rpm.

The system and methodology described herein provide a solid, conductive electrical path through downhole components which move relative to each other. For example, a conductive path may be formed between a stationary structure and a rotating component which rotates about the stationary structure in a downhole tool. The continuous electrical connection during the continuous mechanical movement, e.g. rotation, may be created through various types of rolling element bearings. In one example, the conductive paths or wiring associated with the stationary structure are conductively connected to a stationary bearing race ring, and the conductive paths or wiring associated with the rotating structure are conductively connected to a rotating bearing race ring, or vice versa.

In some embodiments, the rolling element bearings may be preloaded to avoid separation of race rings and rolling elements, thus preventing disruptions to current flow due to disconnection of contact between the bearing elements while in a downhole environment susceptible to shock and vibration. Additionally, the rolling element bearings may be packaged with appropriate insulation so that the electric signals, e.g. power signals and/or data signals, follow the intended path along separate, electrically independent poles. The bearing system also may comprise a plurality of rolling element bearings selectively placed to create a rugged, multi-conductor electrical transmission assembly. The conductive bearings can be utilized in a variety of downhole tools, including wired mud motors, wired coiled tubing orienter tools, rotary steerable systems, and other downhole tools having components which undergo relative motion.

The style of conductive bearing may vary from one downhole application to another depending on the environment and on the specific parameters of a given wellbore operation. By way of example, the conductive bearings may comprise ball bearings, e.g. deep groove ball bearings or axial ball bearings, in which the conductive rolling element comprises a plurality of conductive balls. However, the conductive bearings also may comprise other types of bearings, including roller style bearings, in which the conductive rolling element comprises a plurality of conductive rollers. Examples of roller bearings and conductive rollers include angular contact roller bearings, crossed roller bearings, tapered roller bearings, cylindrical roller bearings and needle bearings. The specific type of bearing may be selected according to desired parameters, such as a desired preload on the rolling elements to avoid separation of conductive contact in a high shock and vibration environment. Furthermore, the rolling element bearings used for transmission of electrical communication and/or for electrical power transfer may be used simultaneously for the structural support of the mechanical components which rotate relative to each other, i.e. the bearings may have both electrical and mechanical characteristics.

Many types of downhole applications and downhole tools may benefit from the conductive bearing systems described herein which provide a relatively simple, dependable system for transmitting electric signals, e.g. power or data signals, downhole and/or uphole. Referring generally to FIG. 1, an example of a well system 20 is illustrated as incorporating a downhole tool 22 having a first component 24 and a second component 26 which may be moved relative to first component 24. For example, the second component 26 may be rotated with respect to first component 24. In some embodiments, the second component 26 rotates while the first component 24 is rotationally stationary, however other embodiments may utilize rotation of both the second component 26 and the first component 24 but at different rotational speeds.

The second component 26 is movably, e.g. rotatably, coupled to the first component 24 via one or more conductive bearings 28. The conductive bearings 28 may be individually or collectively coupled with one or more electrically conductive communication lines 30 which carry electric signals, e.g. electric power signals and/or electric data signals. The signals are passed through the downhole tool 22 to enable communication with a device 32 located on the downhole side of tool 22. The device 32 may comprise one or more devices in the form of sensors, gauges, measurement-while-drilling systems, logging-while-drilling systems, or a variety of other downhole devices which output or receive electric signals and/or require electrical power. Each electrically conductive communication line 30 may be divided into a downhole electric lead 34 coupled to a downhole side of the corresponding bearing 28 and an uphole electric lead 36 coupled to an uphole side of the same corresponding bearing 28. The leads 34, 36 may be connected to bearings 28 by soldering, connectors, or other suitable fasteners.

As discussed above, the downhole tool 22 may have a variety of forms depending on the specific wellbore operation being conducted. If, for example, the wellbore operation is a drilling operation utilizing a drill bit 38 to drill a desired wellbore, the downhole tool 22 may comprise a mud motor assembly 40. In drilling operations, as well as other downhole applications, the downhole tool 22 also may comprise an orienter tool assembly 42 (shown in dashed lines). The orienter tool assembly 42 may be combined with coiled tubing in coiled tubing drilling applications or other downhole applications. In both drilling operations and other downhole applications, the downhole tool 22 also may comprise a variety of bottom hole assemblies, such as a bottom hole assembly having a rotary steerable system 44 (shown in dashed lines) to enable, for example, directional drilling. It should be noted that the various downhole tools 22 have been illustrated and described as examples of downhole tools having components which undergo relative movement while performing downhole operations. Depending on the specific downhole application, the various downhole tools 40, 42, 44 may be used alone or in various combinations. When used in combination, sequential assemblies of the conductive bearings 28 may be employed in the sequential downhole tools 22 to enable transmission of electric signals through the various movable components.

The overall well system 20 also may have a variety of configurations. For purposes of explanation, however, the well system 20 has been illustrated as comprising a drill string 46 deployed in a wellbore 48. Depending on the drilling application, the drill string 46 may comprise mud motor assembly 40, orienter tool assembly 42, and/or rotary steerable system 44 which may each or all be used to control the drill bit 38. The drill string 46 may include many additional and/or other types of components depending on the specific design of the well system 20.

In a drilling application, a drilling fluid, e.g. drilling mud, is pumped down through an interior of the drill string 46, through drill bit 38, and then up through an annulus 50 between the drill string 46 and the surrounding wellbore wall 52. The flowing drilling fluid or drilling fluid flow path is represented by arrows 54 in FIG. 1. The drilling fluid is pumped down through drill string 46 under pressure to remove drill cuttings up through the annulus 50. As described in greater detail below, the bearings 28 may be isolated from the drilling mud to facilitate long-term, dependable conductive contact and transmission of electric signals along the drill string 46.

Figure 2:
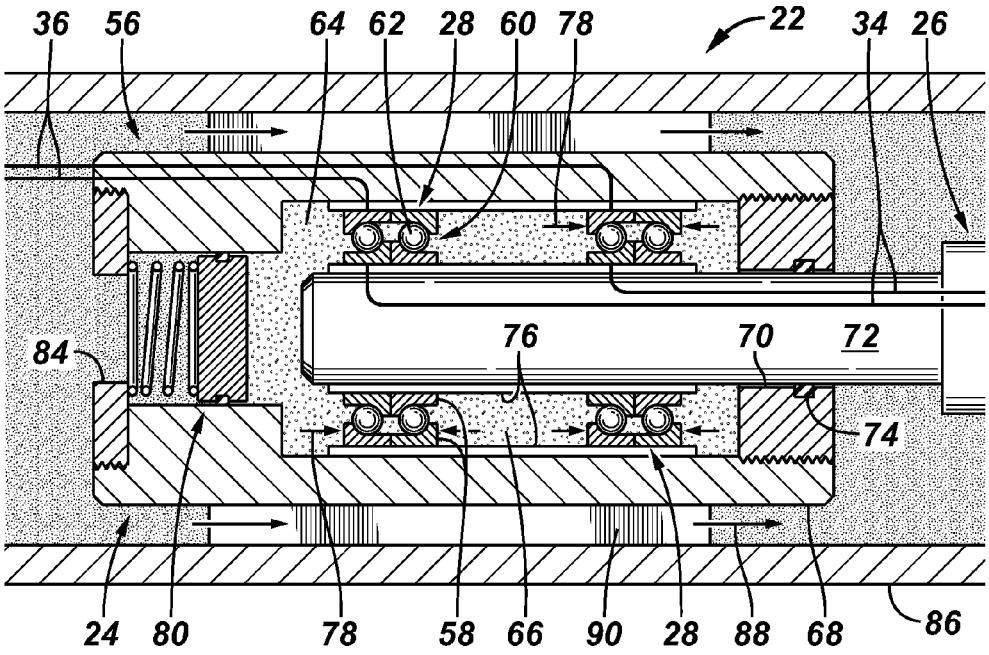
FIG. 2 is a cross-sectional view of an embodiment of a system for conducting electric signals through bearings from a first well component of a downhole tool to a second well component of the downhole tool, wherein the second well component moves relative to the first well component, according to an embodiment of the present disclosure.

Referring generally to FIG. 2, an embodiment of downhole tool 22 is illustrated with a conductive bearing assembly 56 having a plurality of conductive bearings 28, e.g. two conductive bearings 28, designed to provide a conductive path for the flow of electric signals. In this embodiment, each conductive bearing 28 comprises first and second conductive race rings 58 and a conductive rolling element 60 positioned between and in contact with both conductive race rings 58. In this particular example, the conductive rolling element 60 comprises a plurality of conductive balls 62 which cooperate with the conductive race rings 58 to form conductive ball bearings. Electric leads 36 may be connected to first conductive race rings 58, e.g. outer conductive race rings, and electric leads 34 may be connected to second conductive race rings 58, e.g. inner conductive race rings. The electric leads 36 are routed through first component 24 of downhole tool 22, and the electric leads 34 are routed through second component 26 of downhole tool 22.

In the embodiment illustrated, the bearings 28 are located in an isolated cavity 64 which may contain an isolating fluid 66, such as an incompressible oil or other fluid having suitable insulating/dielectric qualities. The isolated cavity 64 is located in an internal housing 68 which forms part of first component 24. The internal housing 68 comprises an opening 70 through which a shaft 72 of second component 26 is received. The shaft 72 extends into cavity 64 and is rotatably received by bearings 28. Additionally, a seal 74 may be located about shaft 72 within the opening 70. By way of example, the leads 34, 36 may be routed along passages formed in shaft 72 and housing 68.

As illustrated, the first or outer conductive race rings 58 may be mounted to, e.g. affixed to, the first component 24. By way of example, the outer conductive race rings 58 are mounted to an interior of internal housing 68. Similarly, the second or inner conductive race rings 58 may be mounted to, e.g. affixed to, the second component 26. By way of example, the inner conductive race rings are mounted to the shaft 72 so that the rolling element 60 of each bearing 28 is secured between the outer and inner conductive race rings 58. To ensure the bearings 28 are isolated, appropriate electrical insulation 76, e.g. layers/pads of insulation, may be positioned between the conductive race rings 58 and the corresponding structure to which the race rings 58 are mounted. For example, an electrical insulation layer/pad 76 may be positioned between the outer conductive race rings 58 and an interior wall of internal housing 68, and another electrical insulation layer/pad 76 may be positioned between the internal conductive race rings 58 and shaft 72. In some applications, it can be beneficial to preload the bearings 28 by applying a suitable preload force, as indicated by arrows 78, to ensure firm, conductive contact between bearing components. The preload may be established by providing appropriate shoulders, spring washers, and/or bearing nuts on housing 68 and/or shaft 72.

The isolating fluid 66 may undergo volume changes due to pressure and temperature changes downhole. Accordingly, a pressure compensator 80 may be connected to internal housing 68 in communication with isolated, internal cavity 64 to compensate for changes in volume (and thus changes in pressure) of the isolating fluid 66 as the isolating fluid provides electrical insulation for bearings 28. A variety of compensators 80 may be employed, but one example utilizes a spring-loaded piston 80 sealably mounted within an opening 84 extending through internal housing 68.

The bearing assembly 56 and internal housing 68 may be employed in a variety of downhole applications and in a variety of downhole tools 22. For example, the bearing assembly 56 and internal housing 68 may be employed in drilling applications. In one example, the internal housing 68 is mounted within an external housing 86 of drill string 46 to create fluid flow paths, as indicated by arrows 88. As indicated, the fluid flow paths 88 may be routed externally of internal housing 68 to conduct, for example, a flow of drilling fluid e.g. drilling mud, through the downhole tool 22. The bearings 28 and the interior of cavity 64 remain isolated from the flow of drilling fluid along fluid flow paths 88. The internal housing 68 may be held at a desired position within external housing 86 by a centralizer 90 or other suitable mechanism.

Figure 3:
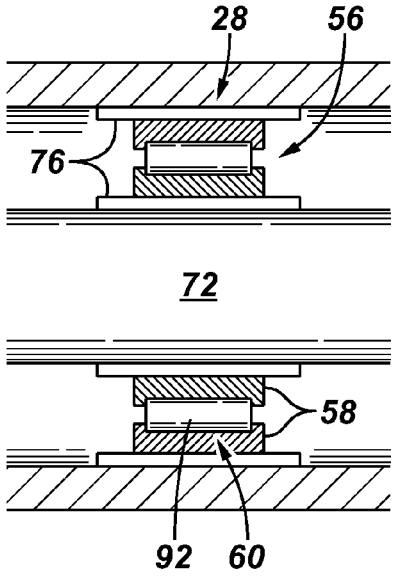
FIG. 3 is a schematic view of an alternate embodiment of a conductive bearing which may be used in the well system, according to an alternate embodiment of the present disclosure.

It should be noted that bearings 28 may have a variety of shapes, sizes and configurations depending on the parameters of a specific downhole application. As illustrated in FIG. 3, for example, the conductive bearings 28 may utilize roller style bearings in which the conductive rolling element 60 comprises a plurality of conductive rollers 92. Examples of roller bearings and conductive rollers 92 include angular contact roller bearings, crossed roller bearings, tapered roller bearings, cylindrical roller bearings and needle bearings. The specific type of bearing may be selected according to desired parameters, e.g. the desired preload 78 on the rolling elements for avoiding separation of conductive contact in a high shock and vibration environment By way of example, the downhole tool 22 illustrated in FIG. 2 may comprise a wired mud motor for use in mud motor assembly 40. In this example, the first component 24 may comprise a stationery collar or housing and the second component 26 may comprise a rotating output shaft, such as shaft 72. When downhole tool 22 comprises a mud motor, the bearing assembly 56 may be positioned above the rotor or rotor catcher of the mud motor assembly 40. A flexible connection element may be provided to carry the wires/electric leads 34 from the rotating shaft 72 to a top of the rotor. The electric leads 34 may be routed through a bore in the center of the rotor all the way down to an electrical connector in a bit box of the drilling assembly.

In another application, the downhole tool 22 illustrated in FIG. 2 comprises the wired, coiled tubing orienter tool assembly 42. Electricity is supplied through bearings 28 of bearing assembly 56 to tools, e.g. logging-while-drilling tools, running below the orienter tool assembly 42. In some applications, orienter tool assembly 42 may be positioned above a mud motor assembly, e.g. mud motor assembly 40, which may also employ conductive bearings 28.

Figure 4:
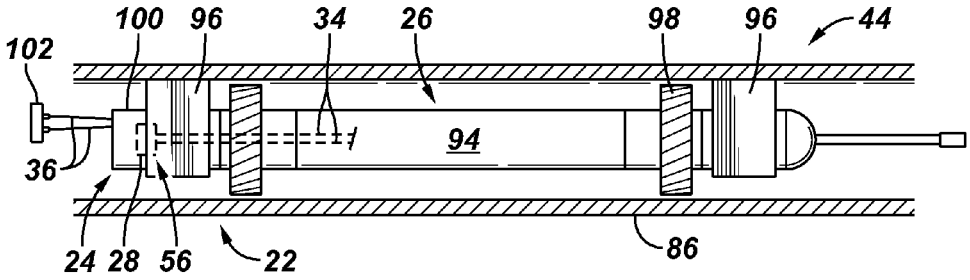
FIG. 4 is a side view of an embodiment of a downhole device having components which move relative to each other and through which electric signals may be transferred via conductive bearings, according to an embodiment of the present disclosure.

In another application, the downhole tool 22 comprises a rotary steerable system 44, e.g., a push-the-bit-type rotary steerable system (such as is shown, for example, in U.S. Pat. and Publication Nos. 5,265,682; 5,582,678; 5,603,385; 7,188,685; and 2010-0139980), to enable transfer of electrical power and/or electrical data signals into a roll stabilized control unit without the need for wireless transmission systems. An example of the rotary steerable system 44 is illustrated in FIG. 4 and is designed to enable exchange of electric power and/or data with a control unit 94 without the use of wireless transmissions via short hop receivers. In this example, control unit 94 is a rotating control unit mounted in a pair of hangers 96 which also support torquers 98. The bearing assembly 56 may be located in a connector box 100 disposed within external housing 86. The collar side electric leads 36 may be terminated in a standard LTB connector 102. By way of example, the conductive bearings 28 and bearing assembly 56 may be coupled with wired drill pipe to provide a high data transmission rate. The application of rolling element bearings for electrical power and/or signal transmission also may be used on the downhole end of a push-the-bit-type control unit, for example, to communicate with and/or to power electronic components situated in the bias unit.

In any of the embodiments described herein, the bearings 28 may be employed not only for transmitting electricity but also to provide mechanical support. By enabling electric transmission while simultaneously providing mechanical support via bearings 28, the overall downhole tool 22 and the overall well system 20 can be substantially simplified for a variety of well related applications.

Depending on the application and environment in which downhole tool 22 is utilized, additional measures may be implemented to prevent mud invasion into cavity 64. If mud or other environmental fluids enter cavity 64, the fluid 66 or other features within cavity 64 can potentially become conductive and create short-circuits between the independent electrical poles. This risk can be mitigated by applying thin gap insulation principles (see also insulation layers 76) such as utilizing a thin and long gap between the poles to limit leakage current and to prevent electrical shorting. In this example, the insulation layers for the stationery and the rotating side may be formed into a geometry where they come in very close contact without touching, thus forming a very thin gap, separating electrically conductive elements from each other (e.g., electrical power from electrical ground or similar). This will increase the electrical resistance of any unwanted, invading conductive fluid intruding into the gap and thus limit the short circuit current, thereby protecting the electrical equipment on both sides of the rotating assembly.

Another risk associated with mud invasion is the interference of solid particles moving between the rolling element 60 and the corresponding contact surfaces within conductive race rings 58 of bearing 28. If sufficient particles move between the respective running contact surfaces of the rolling element 60 and the corresponding conductive race rings 58, the rolling elements 60 can be lifted from the running surfaces and cause an interruption in electrical conductance. An example of one system and methodology for mitigating this risk is illustrated in FIG. 5 as utilizing point contacts formed between the conductive rolling element 60 and the conductive race rings 58.

Figure 5:
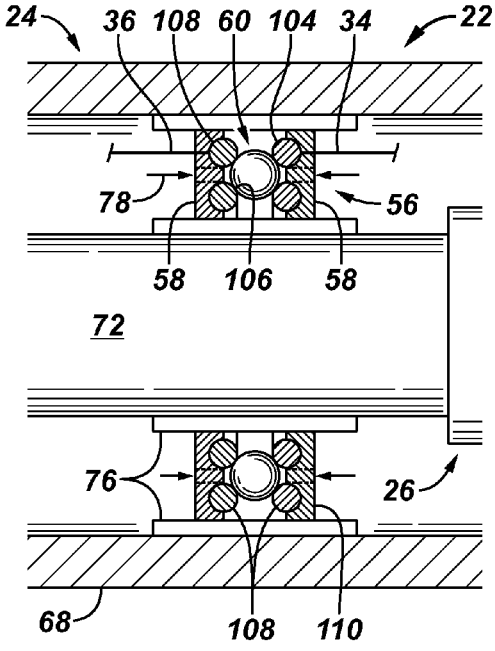
FIG. 5 is a cross-sectional view of an alternate embodiment of a conductive bearing which may be used in the well system, according to an alternate embodiment of the present disclosure.

In the specific example illustrated in FIG. 5, the conductive race rings 58 are formed with convex surfaces 104 or other suitable surfaces able to form a more focused contact 106, referred to as a point contact, with the rolling element 60. By way of example, the rolling element 60 may comprise a plurality of conductive balls 62 or conductive rollers 92. In one embodiment, each conductive race ring 58 comprises a pair of conductive rings 108, such as conductive O-rings, with each pair of conductive rings 108 being held by a corresponding race ring holder 110. By way of example, the conductive rings 108 may comprise metal O-rings. The conductive rings 108 cooperate to secure the rolling element 60 therebetween, and preload forces 78 may be applied to race ring holders 110 to help maintain constant conductive contact between the conductive race rings 58 and the conductive rolling element 60 while helping force out any undesirable particles.

Figure 6:
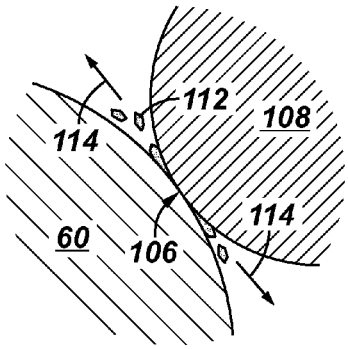
FIG. 6 is an enlarged view of a portion of the bearing system illustrated in FIG. 5 which is designed to remove particles so as to maintain conductive contact between bearing portions, according to an alternate embodiment of the present disclosure.

As better illustrated in FIG. 6, the resulting point contact 106 between the two convex radii of rolling element 60 and conductive rings 108 forces particles 112 away from the point contact 106. The design causes the particles 112 to be rejected by creating a squeezing effect which forces the particles 112 out of the way, as indicated by arrows 114, rather than trapping them between the rolling element 60 and the interior surfaces of conductive race rings 58. In some applications, the radii of the rolling elements 60 and the metal O-ring 108 may be made small to increase this effect further. In a more extreme example, the radius of contact on the metal O-ring may be reduced such that a knife edge contact is created to further improve particle rejection.

In the embodiments described herein, the conductive bearings 28 provide a simple, reliable approach to transmitting electrical signals between components which move relative to each other. In some applications, one component may be rotationally stationary while the other component rotates. In other applications, however, both components may rotate or otherwise move at different speeds relative to each other. Single or multiple bearings 28 may be employed in a variety of bearing assemblies and may be arranged sequentially or in other patterns according to the design of a given downhole tool 22. For example, multiple conductive rolling element bearings 28 may be used in a tool to provide a rugged, multi-conductor, electrical transmission assembly. The size and configuration of internal housing 68 and cavity 64 may be adjusted and may be designed for cooperation with a variety of compensators, electrical leads and/or electrical lead connection mechanisms. Additionally, the conductive bearing system may be incorporated into a variety of downhole tools for use in many types of downhole, well related applications. Individual or multiple downhole tools 22 incorporating conductive bearings 28 may be employed in individual well systems 20.

Although only a few embodiments of the present disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of forming an electrical connection through components capable of having relative rotational movement in a downhole tool assembly, comprising:

providing a bearing with a first conductive race ring, a second conductive race ring, and a conductive rolling element positioned between and in contact with the first conductive race ring and the second conductive race ring;

affixing the first conductive race ring to a rotationally stationary component of a downhole well system assembly and affixing the second conductive race ring to a rotatable component which is able to rotate relative to the rotationally stationary component;

coupling a first electric lead to the first conductive race ring and coupling a second electric lead to the second conductive race ring to form an electrically conductive flow path through the bearing;

placing the bearing in a cavity filled with fluid to isolate the bearing from a surrounding environment; and connecting a compensator with the cavity to compensate for changes in volume of the fluid.

2. The method as recited in claim 1, wherein affixing comprises affixing the first conductive ring and the second conductive ring into a mud motor assembly.

3. The method as recited in claim 1, wherein affixing comprises affixing the first conductive ring and the second conductive ring into an orienter tool assembly.

4. The method as recited in claim 1, wherein affixing comprises affixing the first conductive ring and the second conductive ring into a bottom hole assembly of a drill string.

5. The method as recited in claim 1, wherein affixing comprises affixing the first conductive ring and the second conductive ring into a rotary steerable system for directional drilling.

6. The method as recited in claim 1, wherein providing a bearing comprises providing a ball bearing in which the conductive rolling element comprises a plurality of conductive balls.

7. The method as recited in claim 1, wherein providing a bearing comprises providing a roller bearing in which the conductive rolling element comprises a plurality of conductive rollers.

8. The method as recited in claim 1, wherein placing comprises placing the bearing in the cavity filled with an incompressible, electrically insulating fluid; and further isolating the bearing by mounting the first and second conductive races on insulator pads.

9. The method as recited in claim 1, wherein providing comprises providing a plurality of bearings with each bearing being conductive to enable formation of a plurality of the electrically conductive flow paths.

10. The method as recited in claim 1, further comprising deploying the downhole well system assembly into a wellbore.

11. The method as recited in claim 10, further comprising pumping drilling mud through the downhole well system along a drilling mud flow path external to the cavity.

* * * * *